US007394333B2

(12) United States Patent
Ezzeddine et al.

(10) Patent No.: US 7,394,333 B2
(45) Date of Patent: Jul. 1, 2008

(54) DIRECTIONAL COUPLER

(75) Inventors: Hilal Ezzeddine, Tours (FR); François Dupont, Tours (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/729,682

(22) Filed: Dec. 5, 2003

(65) Prior Publication Data

US 2004/0113716 A1 Jun. 17, 2004

(30) Foreign Application Priority Data

Dec. 6, 2002 (FR) ..... 02 15477

(51) Int. Cl.
*H01P 5/00* (2006.01)
*H01P 5/12* (2006.01)

(52) U.S. Cl. ..... 333/109; 333/116

(58) Field of Classification Search ..... 333/109, 333/112, 116, 126
See application file for complete search history.

(56) References Cited

U.S. PATENT DOCUMENTS 3,593,208 A * 7/1971 Smith ..... 333/112
4,027,254 A * 5/1977 Gunton et al. ..... 333/109
4,375,054 A * 2/1983 Pavio ..... 333/116
4,937,541 A 6/1990 Podell et al.
5,243,305 A * 9/1993 D'Oro et al. ..... 333/116
5,629,654 A 5/1997 Frick
6,018,277 A * 1/2000 Vaisanen ..... 333/26
6,323,741 B1 * 11/2001 Kim ..... 333/116
6,483,415 B1 * 11/2002 Tang ..... 336/200
6,683,512 B2 * 1/2004 Nakamata et al. ..... 333/126
6,825,738 B2 * 11/2004 Shumovich ..... 333/112

OTHER PUBLICATIONS

French Search Report from French Patent Application 02/15477, filed Dec. 6, 2002.
Ojha S. et al. "Reduced Size RF Coupler Design For Specialized Load Requirements" Circuits and Systems, 1997. Proceedings Of The 40th Midwest Symposium on Sacramento, CA, USA Aug. 3-6, 1997, New York, NY USA, IEEE, US, Aug. 3, 1997, pp. 595-598.
Patent Abstracts of Japan, vol. 005, No. 125 (E-069), Aug. 12, 1981 & JP 56 062402 A (Fujitsu Ltd.), May 28, 1981.
Patent Abstracts of Japan, vol. 018, No. 022 (E-1490), Jan. 13, 1994 & JP 05 259717 A (NEC Corp.), Oct. 8, 1993.
Cne J-L et al. "A High-Directivity Microstrip Directional Coupler With Feeback Compensation" 2002 IEEE MTT-S International Microwave Symposium Digest. (IMS 2002). Seattle, WA Jun. 2-7, 2002, IEEE MTT-S International Microwave Symposium, New York, NY: IEEE, US, vol. 1 of 3, Jun. 2, 2002, pp. 101-104.
Patent Abstracts of Japan, vol. 2003, No. 02, Feb. 5, 2003 & JP 2002 299922 A (Kyocera Corp.), Oct. 11, 2002.

* cited by examiner

*Primary Examiner*—Dean O Takaoka
(74) *Attorney, Agent, or Firm*—Lisa K. Jorgenson; James H. Morris; Wolf, Greenfield & Sacks, P.C.

(57) ABSTRACT

A coupler of distributed type including a first conductive line carrying a main signal between two end terminals, a second conductive line coupled to the first one and between two terminals of which flows a sampled signal, proportional to the main signal, and two capacitors respectively connecting the two terminals of each of the lines.

23 Claims, 1 Drawing Sheet

Central frequency ranges from a few tens of MHz to a few tens of GHz

DIRECTIONAL COUPLER

BACKGROUND OF THE INVENTION

1. Field of the Invention

The present invention relates to the field of couplers which are used to capture a portion of a signal conveyed by a transmission line for, in particular, measurement or control purposes. The present invention more specifically relates to the field of radiofrequency couplers between a transmit amplifier and an antenna, especially applied to mobile telephony.

2. Discussion of the Related Art

FIG. 1 very schematically illustrates the general structure of a distributed coupler 1, that is, with transmission lines of the type to which the present invention applies, as opposed to couplers with localized inductive and capacitive elements.

Coupler 1 is interposed between an amplifier 2 (PA) for amplifying a signal Tx to be transmitted, and a transmit antenna 3. The function of coupler 1 is to extract, between terminals CPLD and ISO of a secondary line 12, a signal proportional to the signal transiting over a main transmission line 11, that is, between terminals IN and DIR, respectively connected to the output of amplifier 2 and to the input of antenna 3.

Signal G extracted by coupler 1 is exploited by a circuit 4 (DET), for example to control the power of amplifier 2 or to turn it off in case of a need for protection, for example, in case of a disappearing of antenna 3.

This is an example of application to mobile telephony where the highest power consumption is due to the transmission chain and where the circuit power consumption is generally desired to be minimized. In receive mode, a mobile phone exploits a low-noise amplifier (LNA), the gain of which is generally fixed and for which a coupler is accordingly not necessary.

The coupler of FIG. 1 is a bidirectional coupler in that it detects a signal present on transmission line 11 in both directions: a forward signal (FWD) transiting from IN to DIR will be coupled towards output CPLD, and a reverse signal (REV) transiting from DIR to IN will be coupled towards output ISO. In practice, the voltages present on terminals CPLD and ISO are rectified to generate gain correction signal G.

A distributed coupler of the type shown in FIG. 1 is characterized by its coupling and its directivity. The coupling characterizes the difference between the amplitude of the main signal circulating on line 11 and the amplitude of the signal sampled from line 12. The directivity characterizes the difference between the amplitude of signal FWD, which translates as a signal coming out of terminal CPLD, and the amplitude of signal REV circulating from DIR to IN, which translates as a signal coming out of terminal ISO. The greater the amplitude difference between terminals CPLD and ISO, the greater the coupler directivity and the easier it is to detect a possible problem of antenna 3 translating as a reflection of the signal carried by line 11. Indeed, in case of a problem on the antenna (for example a disappearing thereof), the power that cannot come out is reflected, which results in an increase in the signal on terminal ISO. By detecting the potential of terminal ISO with respect to a threshold, a problem can be detected on the antenna and the transmit amplifier can then be cut off to avoid damaging it, since said amplifier generally cannot stand receiving a reflected power.

In an ideal coupler and in normal operation, the amplitude maximum of the coupled line would be present on terminal CPLD and a zero voltage would be present on terminal ISO. However, in practice, the voltage of terminal ISO is not zero, but it is generally attenuated by on the order of −30 dB with respect to the voltage of terminal DIR.

Further, a low coupling is generally searched to avoid sampling too large a portion of the output for the detection. Generally, terminal CPLD reproduces a signal attenuated by on the order of from −15 to −20 dB with respect to the signal transiting from terminal IN to terminal DIR.

Accordingly, the directivity of a conventional coupler is on the order of from −10 dB to −15 dB (−30−(−20) to −30−(−15)).

Now, especially to ease the detection of a problem on the antenna, a higher directivity is desired.

To improve the directivity, the coupler can be enlarged by making conductive sections 11 and 12 close to a length of $\lambda/4$, where $\lambda$ represents the wavelength corresponding to the central frequency of the desired coupler passband. However, developing a distributed coupler at a $\lambda/4$ length results in a very bulky coupler and increases insertion losses.

FIG. 2 shows a conventional embodiment of a coupler 10 with an improved directivity. This coupler of distributed type comprises two conductive lines 11 and 12 and two capacitors Cp respectively connecting terminals iN and CPLD and terminals DIR and ISO. Such capacitors enable increasing the coupler directivity by drawing the values of the line impedances closer to one another. However, a disadvantage of such a solution is that at frequencies of several hundreds of MHz, the capacitance values are very small (on the order of one femtofarad). In practice, such values make the implementation almost impossible since the values of capacitances Cp come close to the values of stray capacitances which can then not be neglected. Now, the features of the coupler significantly degrade as soon as it is departed from the values selected, according to the coupler passband, for capacitors Cp.

Examples of couplers of the type described in relation with FIG. 2 are described in U.S. Pat. No. 4,937,541 and in German patent application 19749912, both of which are incorporated herein by reference.

SUMMARY OF THE INVENTION

The present invention aims at providing a coupler with distributed lines of improved directivity.

The present invention especially aims at providing a radiofrequency coupler which does not require use of capacitors of very small value (on the order of one fF).

The present invention also aims at providing a coupler having a reduced bulk.

To achieve these and other objects, the present invention provides a coupler of distributed type comprising a first conductive line carrying a main signal between two end terminals, a second conductive line coupled to the first one and between two terminals of which flows a sampled signal, proportional to the main signal, and two capacitors respectively connecting the two terminals of each of the lines.

According to an embodiment of the present invention, the lines are of same length.

According to an embodiment of the present invention, the capacitors are of same values.

According to an embodiment of the present invention, the lines are sized in $\lambda/4$ for a central band frequency greater than the frequency band for which the coupler is intended.

According to an embodiment of the present invention, each conductive line is formed of at least two parallel sections between its end terminals, the sections of the two lines being interlaced.

According to an embodiment of the present invention, the capacitor electrodes are formed in the same two metallization levels as those in which are formed the conductive lines.

According to an embodiment of the present invention, the capacitors have values ranging between 0.1 and 10 pF, the central frequency of the coupler ranging between a few tens of MHz and a few tens of GHz.

The foregoing objects, features, and advantages of the present invention will be discussed in detail in the following non-limiting description of specific embodiments in connection with the accompanying drawings.

DETAILED DESCRIPTION

Figure 1:
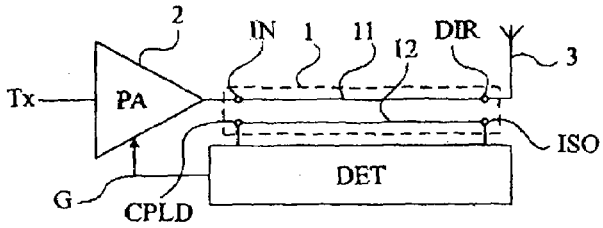
FIG. 1, previously described, schematically shows a bidirectional coupler of the type to which the present invention applies in a radiofrequency transmission chain environment.

The same elements have been referred to with the same reference numerals in the different drawings. For clarity, only those elements that are necessary to the understanding of the present invention have been shown in the drawings and will be described hereafter. In particular, the signals crossing the coupler, as well as what exploitation is made of the measurements by the coupled line have not been detailed, the present invention being implementable whatever application is made of the signals issued by the coupler.

A feature of the present invention is to provide capacitors, no longer to connect the respective ends of a line to the ends of the other line, but to interconnect the respective ends of a same line.

Figure 2:
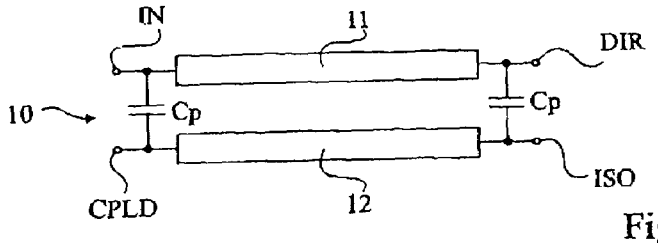
Fig 2 (Prior Art)
FIG. 2, previously described, shows a conventional example of a directional radiofrequency coupler.

Such an arrangement enables, for a same frequency band, improving the directivity while using capacitors of higher values than in the conventional case of FIG. 2.

The fact that the capacitors have substantially higher values makes the coupler (especially its directivity) less sensitive to variations in the capacitor values due to technological dispersions or due to the presence of stray capacitances which remain on the order of one femtofarad.

Figure 3:
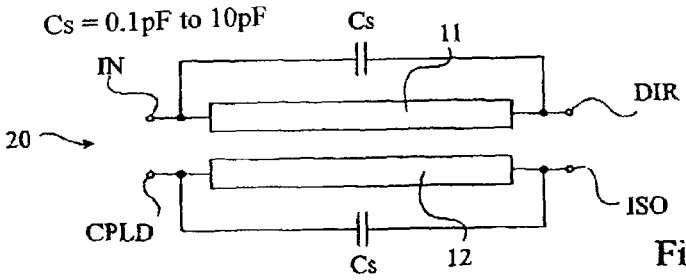
FIG. 3 shows an embodiment of a directional coupler according to the present invention.

FIG. 3 shows a coupler 20 according to a first embodiment of the present invention. It shows two parallel conductive lines 11, 12 like in the embodiment of FIG. 2. Line 11 forms the main line of terminals IN and DIR. Line 12 corresponds to the coupled line of terminals CPLD and ISO.

According to the present invention, a first capacitor Cs connects terminals IN and DIR while a second capacitor Cs connects terminals CPLD and ISO.

Lines 11 and 12 have the same lengths and capacitors Cs both have the same value.

The sizing of the conductive lines and of the capacitors depends on the application and more specifically on the central frequency of the passband desired for the coupler. In a simple example, sections 11 and 12 have lengths corresponding to $\lambda/4$, where $\lambda$ represents the wavelength of the central frequency of the band. In this case, the addition of capacitors Cs reduces the bandwidth, but already improves the directivity. Further, they enable subsizing the $\lambda$ value, due to the offset that they introduce on the central frequency.

According to a preferred embodiment of the present invention, advantage is taken of the presence of the capacitors to decrease the length of conductive sections 11 and 12 with respect to the size that they would have in $\lambda/4$ with respect to the central frequency of the desired passband. Such an embodiment enables decreasing the coupling (which is maximum at $\lambda/4$), and thus reducing the amplitude of the signal measured on the coupled line with respect to the main line. This thus reduces the power consumption (signal portion) which is not directly useful for the transmission.

Figure 4:
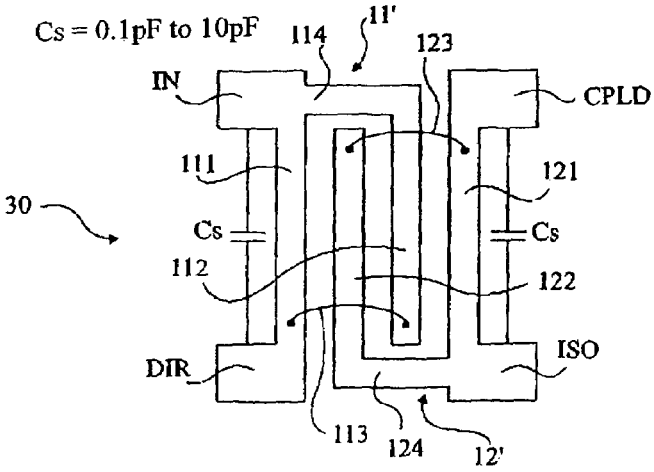
FIG. 4 shows another preferred embodiment of a directional coupler according to the present invention.

FIG. 4 shows a second preferred embodiment of a distributed coupler 30 according to the present invention.

According to this embodiment, a structure known as a Lange coupler, in which the two conductive sections 11' and 12' are interdigited, is used. In the example of FIG. 4, sections each comprising two parallel branches 111 and 112, respectively 121 and 122, interleaved with the branches of the other line, have been provided. In such a structure, each section is, from the electrical point of view, formed of two parallel sections 111 and 112, respectively 121 and 122, between terminals IN and DIR, respectively CPLD and ISO. Perpendicular extensions 114 and 124 of the conductive tracks connect one end of sections 112 and 122, for example, to terminals IN and ISO, respectively. Conductive sections (bridges) 113 and 123 connect the respective free ends of sections 112 and 122 to terminals DIR and CPLD, respectively.

In an embodiment in integrated circuit form, connections 113 and 123 are formed by vias (not shown) and conductive tracks in a second metallization level with respect to the metallization level in which are formed tracks 111, 112, 114, 121, 122, and 124.

According to the present invention, terminals IN and DIR, respectively CPLD and ISO, are connected to each other by capacitors Cs.

An advantage of this embodiment is that the forming of the capacitors takes advantage of the fact that the conductive lines are already formed in two separate metallization levels. Accordingly, these two metallizations levels and the dielectric separating them can be used to form the integrated capacitors Cs specific to the present invention.

In a conventional Lange coupler, that is, without capacitors Cs, the sizing corresponds to individual sections 111, 112, 121, and 122 of length $\lambda/4$ for a central frequency corresponding to wavelength $\lambda$. Such a coupler is generally used to increase the coupling by decreasing stray capacitances.

According to the present invention, due to capacitors Cs, the Lange coupler can be sized for a substantially higher frequency (that is, with a substantially smaller length $\lambda/4$), to obtain the desired operating frequency. In this case, the coupling is decreased and the coupler directivity is increased.

The dimensions of a coupler according to the present invention are chosen according to the application. To take into account that fact that capacitors Cs must have values greater than the stray capacitances, a coupler of the present invention is more specifically dedicated to frequencies ranging between a few tens of MHz and a few tens of GHz. Capacitors Cs then have values ranging between 0.1 and 10 picofarads.

As a comparison, a Lange coupler with no capacitor and a Lange coupler according to the present invention with capacitors Cs of a 3.3-pF capacitance, with section lengths adapted to a 820-MHz frequency, have been formed on a board. Respective directivities of 7 and 28 dB have been obtained.

An advantage of the present invention is that the addition of capacitors Cs slightly increases the coupling while considerably increasing (by more than 10 dB) the directivity. Further, the isolation is improved and insertion losses increase only very slightly (less than 0.5 dB).

In an integrated forming of the structure of FIG. 4, the surface area taken up by such a coupler is substantially the same as for a conventional coupler, the surface area necessary to the capacitor forming being compensated for by the decrease in the length of the conductive sections.

Of course, the present invention is likely to have various alterations, modifications, and improvements which will readily occur to those skilled in the art. In particular, the dimensions to be given to the different conductive sections of the coupler as well as to the capacitors are within the abilities of those skilled in the art based on the functional indications given hereabove.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A directional distributed coupler comprising:

a first conductive line carrying a main signal to be transmitted by an antenna, the main signal being carried between two end terminals of the first conductive line;

a second conductive line coupled to the first conductive line, the second line comprising a first terminal and a second terminal between which flows a sampled signal, proportional to the main signal, the second conductive line being coupled to the first conductive line such that the first terminal provides a first signal that is a function of a magnitude of the main signal flowing in a first direction on the first conductive line, and the second terminal provides a second signal that is a function of a magnitude of the main signal flowing in a second direction on the first conductive line; and a first capacitor having a first capacitor terminal connected to a first one of the two end terminals of the first conductive line and a second capacitor terminal connected to a second one of the two end terminals of the first conductive line, and a second capacitor having a third capacitor terminal connected to the first terminal of the second conductive line and a fourth capacitor terminal connected to the second terminal of the second conductive line.

2. The coupler of claim 1, wherein the lines have a same length.

3. The coupler of claim 1, wherein the capacitors have values that are substantially the same.

4. The coupler of claim 1, wherein the lines are smaller than approximately $\lambda/4$ in length, wherein $\lambda$ is a wavelength for which the coupler is intended to operate.

5. The coupler of claim 1, wherein each conductive line comprises at least two parallel sections between its end terminals, the sections of the two lines being interleaved.

6. The coupler of claim 5, wherein at least one capacitor electrode is formed in a same metallization level as the first conductive line.

7. The coupler of claim 1, wherein the first capacitor has a value ranging between 0.1 and 10 pF, the central frequency of the coupler ranging between a few tens of MHz and a few tens of GHz.

8. A distributed coupler, comprising:

a first conductive line that carries a signal between a first terminal and a second terminal of the first conductive line to deliver the signal to an antenna;

a first capacitor having a first capacitor terminal coupled to the first terminal of the first conductive line and a second capacitor terminal coupled to the second terminal of the first conductive line;

a second conductive line comprising a third terminal and a fourth terminal, the second conductive line being coupled to the first conductive line such that the third terminal provides a first coupled signal that is a function of a magnitude of the signal flowing in a first direction on the first conductive line, and a fourth terminal that provides a second coupled signal that is a function of a magnitude of the signal flowing in a second direction on the first conductive line; and a second capacitor coupled to the third terminal and the fourth terminal.

9. The distributed coupler of claim 8, wherein the first conductive line is smaller than approximately $\lambda/4$ in length, wherein $\lambda$ is a signal wavelength upon which the distributed coupler is designed to operate.

10. The distributed coupler of claim 8, wherein the second conductive line is coupled to a control circuit, the control circuit being coupled to an amplifier that supplies the signal to the first terminal.

11. The distributed coupler of claim 8, wherein at least one capacitor electrode is formed in a same metallization level in which is formed the first conductive line.

12. The distributed coupler of claim 8, wherein the first capacitor and the second capacitor have values between 0.1 and 10 pF.

13. The distributed coupler of claim 8, wherein the directional distributed coupler has a directivity of at least 28 dB.

14. The distributed coupler of claim 8, wherein a central frequency of the directional distributed coupler is between a few tens of MHz and a few tens of GHz.

15. The distributed coupler of claim 8, wherein the second terminal is connected to the antenna.

16. A distributed coupler, comprising:

a first conductive line that carries a signal between a first terminal and a second terminal of the first conductive line to deliver the signal to an antenna;

a first capacitor connected to the first terminal and the second terminal; and a second conductive line coupled to the first conductive line;

wherein the first conductive line is smaller than approximately $\lambda/4$ in length, wherein $\lambda$ is a signal wavelength upon which the distributed coupler is designed to operate.

17. The distributed coupler of claim 16, wherein the second conductive line has a third terminal and a fourth terminal, and further comprising:

a second capacitor connected to the third terminal and the fourth terminal.

18. The distributed coupler of claim 16, further comprising:

a control circuit connected to an amplifier that supplies the signal to the first terminal.

19. The distributed coupler of claim 18, wherein the control circuit is configured to turn off the amplifier when a voltage of the second conductive line exceeds a threshold.

20. The distributed coupler of claim 16, wherein the signal wavelength $\lambda$ corresponds to a signal frequency that is approximately at a center of a frequency passband of the distributed coupler.

21. A distributed coupler, comprising:

a first conductive line that carries a signal between two terminals of the first conductive line to deliver the signal to an antenna;

a second conductive line having two terminals comprising a third terminal and a fourth terminal, the second conductive line being coupled to the first conductive line such that the third terminal provides a first coupled signal that is a function of a magnitude of the signal flowing in a first direction on the first conductive line, and a fourth terminal that provides a second coupled signal that is a function of a magnitude of the signal flowing in a second direction on the first conductive line;

a first capacitor coupled, via different terminals of the first capacitor, respectively, to the two terminals of the first conductive line or the two terminals of the second conductive line; and a second capacitor coupled, via different terminals of the second capacitor, respectively, to the two terminals of the first conductive line or the second conductive line, wherein the second capacitor is coupled to a different one of the first and second conductive lines than the conductive line to which the first capacitor is coupled.

22. The distributed coupler of claim 21, wherein at least one of the first and second lines has a length smaller than $\lambda/4$ in length, wherein $\lambda$ is a signal wavelength upon which the distributed coupler is designed to operate.

23. The distributed coupler of claim 22, wherein the signal wavelength $\lambda$ corresponds to a signal frequency that is approximately at a center of a frequency passband of the distributed coupler.

* * * * *

UNITED STATES PATENT AND TRADEMARK OFFICE

CERTIFICATE OF CORRECTION

PATENT NO. : 7,394,333 B2
APPLICATION NO. : 10/729682
DATED : July 1, 2008
INVENTOR(S) : Hilal Ezzeddine et al.

It is certified that error appears in the above-identified patent and that said Letters Patent is hereby corrected as shown below:

Col. 2, line 22 should read:
respectively connecting terminals IN and CPLD and ter- Signed and Sealed this Nineteenth Day of August, 2008

JON W. DUDAS
*Director of the United States Patent and Trademark Office*